United States Patent [19]

Thorneburg

[11] 4,422,307

[45] Dec. 27, 1983

[54] SOCK

[76] Inventor: James L. Thorneburg, P.O. Box 5440, Statesville, N.C. 28677

[21] Appl. No.: 381,531

[22] Filed: May 24, 1982

[51] Int. Cl.[3] ..... D04B 9/46

[52] U.S. Cl. ..... 66/172 E; 66/202; 2/239

[58] Field of Search ..... 66/178 A, 178, 172 E, 66/202, 173; 2/239

[56] References Cited

U.S. PATENT DOCUMENTS

| | | | |
|---|---|---|---|
| 3,162,029 | 12/1964 | Laws et al. | 66/172 E |
| 3,793,851 | 2/1974 | Thorneburg | 66/185 |
| 4,034,580 | 7/1977 | Holder | 66/172 E |
| 4,237,707 | 12/1980 | Safrit | 66/172 E |
| 4,373,361 | 2/1983 | Thorneburg | 66/185 |

*Primary Examiner*—Ronald Feldbaum

*Attorney, Agent, or Firm*—Bell, Seltzer, Park & Gibson

[57] ABSTRACT

This sock is particularly adapted for wear with western type boots and includes an upper leg portion knit with stretchable yarn having wear-resistant characteristics and a lower leg portion knit with nonstretchable yarn having moisture wicking characteristics. Elastic yarn is incorporated in predetermined repeating courses throughout the entire leg and cooperates with the stretchable yarn in the upper leg portion to provide resiliency for firmly supporting the leg of the sock on the leg of the wearer and cooperates with the moisture wicking characteristics of the yarn in the lower leg portion to remove moisture from the leg of the wearer. The upper and lower leg portions are of substantially the same length and are joined together at substantially the medial portion of the enlarged calf area of the leg of the wearer so that the upper edge of the western boot engages the upper wear-resistant portion of the leg of the sock.

9 Claims, 4 Drawing Figures

SOCK

FIELD OF THE INVENTION

This invention relates generally to a sock adapted to be worn with western type boots and more particularly to such a sock which includes a lower leg portion knit of substantially nonstretchable yarn having moisture wicking characteristics and an upper leg portion knit of stretchable yarn having greater wear-resistant characteristics than the yarn in the lower leg portion.

BACKGROUND OF THE INVENTION

My prior U.S. Pat. No. 3,793,851 discloses a boot sock which includes a relatively narrow upper cuff with elastic yarn incorporated therein and a leg and foot with terry loops formed of a main terry yarn and extending throughout the entire inner surface of the leg and foot. An auxiliary terry yarn is knit in plated relationship with the main terry yarn in the heel and adjacent portions thereto to provide additional fabric thickness so that the heel portion of the sock fills in the enlarged heel of the western type boot. The sock disclosed in my prior patent has been very popular for wear with western type boots. However, it has been found that some wearers object to the relatively thick fabric in the leg of the sock. When this sock is worn with some types of western boots, the upper narrow cuff has a tendency to work itself down the leg of the wearer.

SUMMARY OF THE INVENTION

With the foregoing in mind, it is the object of the present invention to provide a boot sock in which the fabric in the leg is of the normal "dress sock" thickness and the upper leg portion has sufficient compressive force to be maintained in the proper position on the leg of the wearer.

In accordance with the present invention, the boot sock includes integrally knit upper and lower leg portions and elastic yarn is incorporated in predetermined repeating courses throughout both the upper and lower leg portions. The lower leg portion is knit of substantially non-stretchable yarn having moisture wicking characteristics and the upper leg portion is knit of stretchable yarn having greater wear-resistant characteristics than the yarn in the lower leg portion.

The upper and lower leg portions are of substantially the same length with the juncture of the upper and lower leg portions being adapted to engage substantially the medial portion of the enlarged calf area of the leg of the wearer. The upper wear-resistant portion of the leg is adapted to be engaged by the upper edge of the western boot and is adapted to resist wear thereby. The stretchable yarn in the upper leg portion cooperates with the elastic yarn to provide resiliency in the upper leg portion for supporting the leg of the sock on the leg of the wearer. The gripping power of the upper leg portion extends over a wide area of the leg of the wearer to provide firm support and to prevent a binding "tourniquet" effect on the leg of the wearer. The substantially nonstretchable body yarn in the lower leg portion has moisture wicking characteristics and the elastic yarn maintains the lower leg portion in close contact with the leg to remove moisture from the leg of the wearer. The body yarn in the lower leg portion is a spun yarn of a larger size and/or heavier than the body yarn in the upper leg portion to provide "cushion" comfort in the lower portion of the leg of the wearer.

The heel and surrounding area of the sock may include two sets of terry loops, one set being knit with a main terry yarn and the other being knit with an auxiliary terry yarn to provide additional fabric thickness in the heel and adjacent areas so that the heel portion of the sock fills in the enlarged heel of the western boot. The heel and adjacent areas may be formed in the manner disclosed in my prior U.S. Pat. No. 3,793,851.

BRIEF DESCRIPTION OF THE DRAWINGS

Other objects and advantages will appear as the description proceeds when taken in connection with the accompanying drawings, in which—

DESCRIPTION OF THE ILLUSTRATED EMBODIMENT

Figure 4:
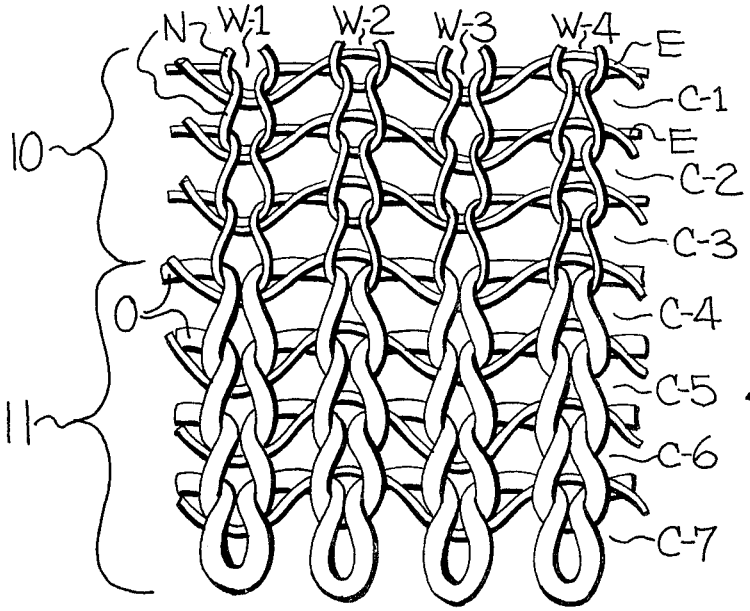
FIG. 4 is a greatly enlarged fragmentary elevational view of the small portion of the sock enclosed by the dotted rectangle 4 in FIG. 2 and illustrating the manner in which the yarns are knit in the adjacent upper and lower portions of the sock.

The sock of the present invention is preferably knit on a circular binary knitting machine and includes an upper leg portion 10 integrally knit with a lower leg portion 11. An elastic yarn, indicated at E in FIG. 4 is incorporated in predetermined repeating courses throughout the upper and lower leg portions 10, 11. As illustrated in FIG. 4, the elastic yarn E is inlaid in what is commonly known as a $1\times1$ manner, and in every course of the knit fabric. The sock also includes a foot having a toe pocket 12 and a heel pocket 13 with a high-splice area 14 above the heel 13 and a cushion sole area 15 extending below the heel pocket 13.

The elastic yarn E draws the fabric inwardly and provides a mock rib appearance throughout both the upper and lower leg portions 10, 11. The upper leg portion 10 is knit with a body yarn, indicated at N in courses C-1 through C-3 and forms plain jersey stitch loops, as indicated in wales W-1 through W-4. The body yarn N is stretchable and has wear-resistant characteristics, such as textured nylon yarn. The body yarn N in the upper leg portion 10 cooperates with the elastic yarn E to provide a resiliency or inward compressive force in the upper leg portion 10 for supporting the leg of the sock over a wide area of the leg of the wearer.

Figure 1:
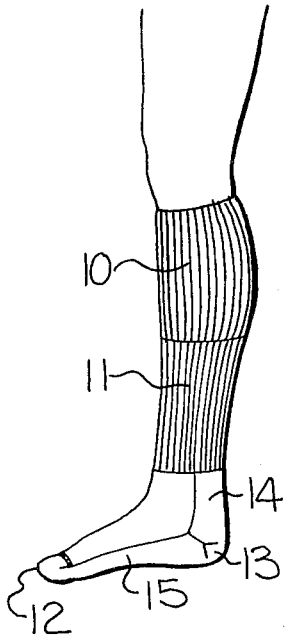
FIG. 1 is a side elevational view of the sock of the present invention and showing the appearance of the same when worn on the leg.
Figure 2:
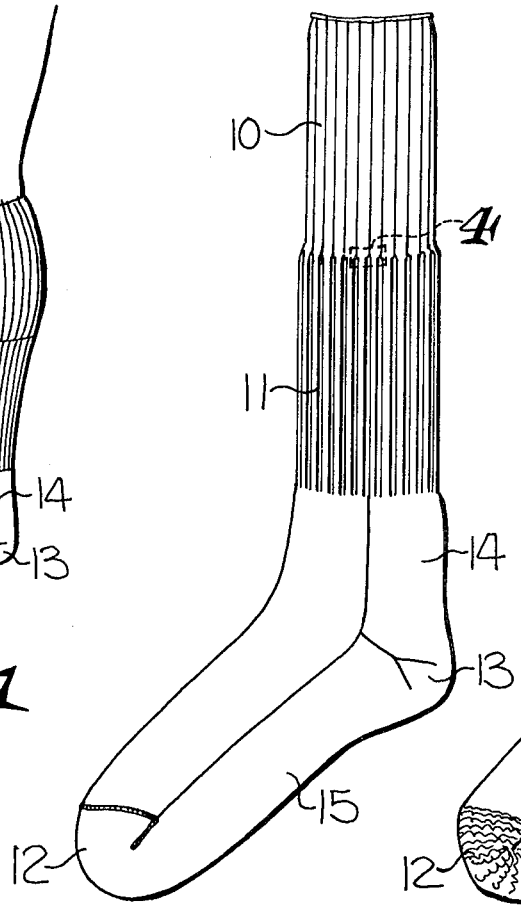
FIG. 2 is a side elevational view of the sock of the present invention, being shown in flattened condition.

The upper leg portion 10 and the lower leg portion 11 are of substantially the same length with the juncture of the upper and lower leg portions being adapted to engage substantially the medial portion of the enlarged calf area of the leg of the wearer, as illustrated in FIG. 1, so that the wear-resistant characteristics of the body yarn N in the upper leg portion 10 resist wear by the upper edge of the western type boot as it rubs thereagainst during walking.

A substantially nonstretchable body yarn O is knit in plain jersey stitches in the lower leg portion 11 and has moisture wicking characteristics, i.e. is hydrophobic. The inlaid elastic yarn E draws the fabric of the lower leg portion 11 into contact with the leg of the wearer to cooperate in removing moisture from the leg of the wearer. The body yarn O is preferably a spun yarn of a larger size and has a softer hand than the body yarn N and also provides a "cushion" comfort to the leg of the wearer. The yarn O is preferably bulky and formed of acrylic fibers, such as Orlon. Thus, the body yarn N in the upper leg portion 10 has greater wear-resistant characteristics than the body yarn O in the lower leg portion 11.

The foot of the sock may be formed in any conventional manner and will be described as being knit in substantially the same manner as that disclosed in my prior U.S. Pat. No. 3,793,851. The high-splice area 14 is knit with the body yarn O and a main terry yarn to form a first set of terry loops extending around the rear half of the sock while the main terry yarn is knit in plated relationship with the body yarn in the front half of the sock, without forming terry loops. A second or auxiliary terry yarn is also knit in the rear half of the sock and forms a second set of terry loops. This auxiliary terry yarn is fed to and forms terry loops on only those needles in that half of the needle cylinder which knits the rear half of the sock. The auxiliary terry yarn is fed by means of a "chopper" feed finger and is floated inside the needles which knit the front half of the sock and is automatically cut to form free ends, as indicated at E in FIG. 3, at each side of the high-splice area 14. The heel pocket 13 is then knit in the usual manner by reciprocation of the needle cylinder and narrowing and widening while continuing to feed both the main and auxiliary terry yarns to form two sets of terry loops thereof. The double sets of terry loops in the high-splice area 14 and the heel pocket 13 thus form thickened fabric areas therein to provide additional fabric thickness therein so that the heel portion of the sock fills in the enlarged heel of the western type boot with which this sock is adapted to be worn.

Figure 3:
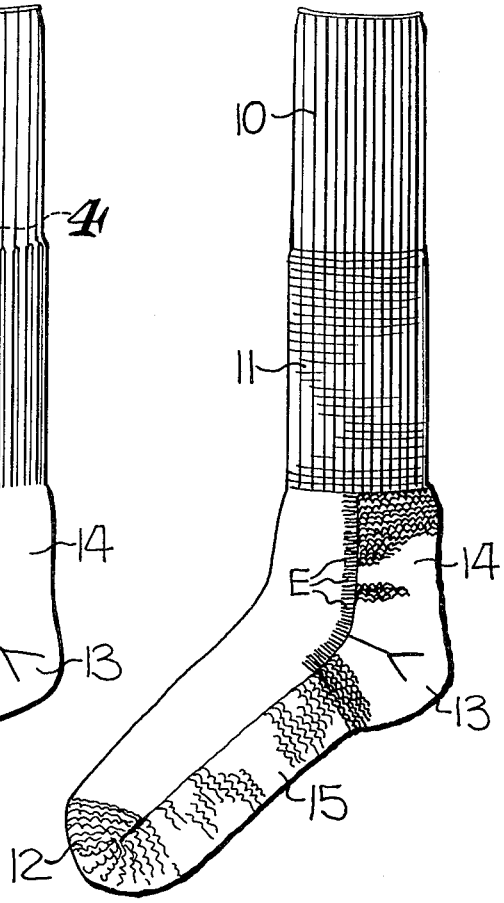
FIG. 3 is a view similar to FIG. 2 but showing the sock of the present invention turned inside out from the position in which it is worn.

Upon completion of the knitting of the heel pocket 13, the sole area 15 is knit by continuing to knit the main terry yarn in plated relationship with the body yarn and forming terry loops in the sole or bottom half of the sock while knitting the main terry yarn with the body yarn, without forming terry loops, in the upper half or instep portion of the foot. If desired, the knitting of the auxiliary terry yarn and the formation of the second set of terry loops therefrom may be continued after completion of the knitting of the heel pocket 13 and for a short distance into the sole area 15, as illustrated in FIG. 3. The toe pocket 12 is knit in the usual manner with the auxiliary terry yarn continuing to form terry loops while the needle cylinder is reciprocated and narrowed and widened segments of the pocket 12 are knit. After completion of the knitting, the toe end of the sock is closed in the usual manner, as by seaming or looping.

While the sock of the present invention has been illustrated and described as having a foot portion similar to the foot portion of my prior U.S. Pat. No. 3,793,581, it is to be understood that the foot of the sock may be of the "tube" type and may be plain knit or may include terry loops in certain portions thereof. In any case, the upper leg portion 10 provides wear-resistant characteristics to the portion of the sock which is engaged by the upper edge of the western boot. The stretchable body yarn in the upper leg portion 10 also cooperates with the elastic yarn to provide resiliency or compressive force in the upper leg portion for firmly supporting the leg of the sock over a wide area of the leg of the wearer. The body yarn in the lower leg portion 11 is substantially nonstretchable and includes moisture wicking characteristics and elastic yarn maintains the lower leg portion in close contact with the leg to aid in the removal of moisture from the leg of the wearer.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A sock including integrally knit upper and lower leg portions, each of said leg portions being knit throughout of body yarn with elastic yarn incorporated in continuously repeated predetermined courses throughout said upper and lower leg portions, said body yarn in said lower leg portion being nonstretchable, having moisture wicking characteristics and being knit in every course of said lower leg portion, said body yarn in said upper leg portion being stretchable and being knit in every course of said upper leg portion, said elastic yarn cooperating with said stretchable body yarn in said upper leg portion to provide resiliency for supporting the leg of the sock on the leg of the wearer, and said elastic yarn cooperating with said moisture wicking body yarn in said lower leg portion to maintain said lower leg portion in close contact with the leg to aid in the removal of moisture from the leg of the wearer.

2. A sock according to claim 1 wherein said body yarn in said lower leg portion is substantially nonstretchable, and wherein said stretchable body yarn in said upper leg portion has greater wear-resistant characteristics than said nonstretchable body yarn in said lower leg portion.

3. A sock according to claims 1 or 2 wherein said upper and lower leg portions are substantially the same length with the juncture of said upper and lower leg portions being adapted to engage substantially the medial portion of the enlarged calf area of the leg of the wearer.

4. A sock according to claims 1 or 2 wherein said body yarn in said upper leg portion is textured nylon.

5. A sock according to claims 1 or 2 wherein said body yarn in said lower leg portion is a spun yarn of acrylic fibers.

6. A sock according to claim 1 wherein said elastic yarn is incorporated in every course throughout said upper and lower leg portions.

7. A sock according to claim 6 wherein said elastic yarn is incorporated by inlaying in a $1 \times 1$ manner.

8. A sock according to claim 7 wherein said body yarn in said lower leg portion is larger than said body yarn in said upper leg portion.

9. A knee-length sock particularly adapted for wear with western type boots and including integrally knit upper and lower leg portions, and a foot knit throughout of body yarn, said upper and lower leg portions being of substantially the same length with the juncture of said upper and lower leg portions being adapted to engage substantially the medial portion of the enlarged calf area of the leg of the wearer, an elastic yarn incorporated in continuously repeated predetermined courses thoughout said upper and lower leg portions, said body yarn in said lower leg portion being substantially nonstretchable, bulky, having moisture wicking characteristics and being knit in every course of said lower leg portion, said body yarn in said upper leg portion being stretchable, having greater wear-resistant characteristics than said body yarn in said lower leg portion to aid in reducing wear by the upper edge of the boot, and being knit in every course of said upper leg portion, said elastic yarn cooperating with said stretchable body yarn to provide resiliency in said upper leg portion for firmly supporting the leg of the sock on a wide area of the leg of the wearer, said elastic yarn cooperating with said moisture wicking body yarn in said lower leg portion to maintain said lower leg portion in close contact with the leg to aid in the removal of moisture from the leg, and said bulky body yarn providing soft comfort characteristics to said lower leg portion.

* * * * *